US005477107A

United States Patent [19]

Tammaru et al.

[11] Patent Number: 5,477,107

[45] Date of Patent: Dec. 19, 1995

[54] LINEAR-BEAM CAVITY CIRCUITS WITH NON-RESONANT RF LOSS SLABS

[75] Inventors: Ivo Tammaru, Rancho Palos Verdes; Christine G. Thoma, Redondo Beach; Roger S. Hollister, Torrance; Robert G. Ripley, Rancho Palos Verdes, all of Calif.

[73] Assignee: Hughes Aircraft Company, Los Angeles, Calif.

[21] Appl. No.: 171,292

[22] Filed: Dec. 21, 1993

[51] Int. Cl.[6] ..... H01J 23/54; H01J 25/34

[52] U.S. Cl. ..... 315/3.5; 315/5.39

[58] Field of Search ..... 315/3.5, 3.6, 39.3, 315/5.39

[56] References Cited

U.S. PATENT DOCUMENTS

| | | | |
|---|---|---|---|
| 3,221,204 | 11/1965 | Hant et al. | 315/3.5 |
| 3,221,205 | 11/1965 | Sensiper | 315/3.5 |
| 3,412,279 | 11/1968 | Allen et al. | 315/3.5 |
| 3,453,491 | 7/1969 | Cerko | 315/3.5 |
| 3,602,766 | 8/1971 | Grant | 315/3.5 |
| 3,876,902 | 4/1975 | Gross | 315/3.5 |
| 4,307,322 | 12/1981 | Chaffee et al. | 315/3.5 |
| 4,504,762 | 3/1985 | Hart et al. | 313/30 |
| 4,859,907 | 8/1989 | Busacca et al. | 315/3.5 |
| 5,162,697 | 11/1992 | Davis et al. | 315/3.6 |

FOREIGN PATENT DOCUMENTS

| | | | |
|---|---|---|---|
| 1298202 | 6/1969 | Germany | 315/3.5 |
| 850521 | 10/1960 | United Kingdom | 315/3.6 |

OTHER PUBLICATIONS

Gilmour, Jr., A. S.; *Microwave Tubes,* Artech House, Inc.; 1986; pp. 201–209 and 302–313.

*Primary Examiner*—Benny T. Lee

*Attorney, Agent, or Firm*—Elizabeth E. Leitereg; Terje Gudmestad; W. K. Denson-Low

[57] ABSTRACT

Lossy slabs are provided in linear-beam tubes such as coupled-cavity TWTs and klystrons to produce a more level tube response over its full operating band, and to eliminate oscillations at the upper cut-off frequency in the TWTs. The slab thicknesses are selected to produce a substantially non-resonant field of about one-quarter wavelength within the slab when the tube is operated within its passband. The slabs are formed from a dielectric material with a conductive mixture of at least about 15%.

17 Claims, 3 Drawing Sheets

LINEAR-BEAM CAVITY CIRCUITS WITH NON-RESONANT RF LOSS SLABS

BACKGROUND OF THE INVENTION

1. Field of the Invention

This invention relates to linear-beam cavity circuits such as coupled-cavity traveling wave tubes (TWTs) and klystrons, and more particularly to the use of RF-lossy dielectric materials in such circuits to provide an improved frequency response of signal amplification.

2. Description of the Related Art

Linear-beam circuits such as TWTs and klystrons cause a stream of electrons to interact with a radio frequency (RF) electromagnetic field in a manner that amplifies the electromagnetic field energy. In a TWT, for example an electromagnetic wave is propagated along a slow-wave circuit, such as a conductive helix wound around the path of the electron stream or a folded waveguide type of structure in which a waveguide is effectively wound back and forth across the path of the electrons. The slow-wave circuit provides a propagation path for the electromagnetic wave that is considerably longer than the axial length of the circuit, so that the traveling wave may be made to effectively propagate at nearly the velocity of the electron beam. The interactions between the electrons in the beam and the traveling wave cause velocity modulations and bunching of the beam electrons. The net result is a transfer of energy from the electron beam to the wave that is traveling along the slow-wave circuit.

The main components of a conventional TWT 2 are illustrated in FIG. 1. An electron gun 4 generates and feeds an electron beam into a slow-wave structure 6. The electron beam is guided through the slow wave structure by a static magnetic focusing field, and is captured at the opposite end of the slow-wave structure 6 by an electron collector 8. The electromagnetic wave is fed into one end of the slow-wave structure through an RF input coupler 10, and is coupled out from the opposite end of the slow-wave structure through an RF output coupler 12. TWTs are commonly used to provide a high degree of signal amplification at microwave and millimeter wave frequencies for communications, radar and other applications.

TWTs and other linear-beam tubes such as klystrons are designed to operate over a given frequency band, such as 3.1–3.5 GHz. However, conventional devices exhibit a non-uniform amplification response at different frequencies within their nominal operating bands, and coupled-cavity TWTs are also subject to oscillations at various cut-offs of the frequency bands in which the circuit can propagate an RF wave. In particular, TWTs tend to be unstable at the high frequency cut-off of the lowest passband, which contains the operating band. In an effort to improve the frequency response and to provide stability, RF-lossy ceramic "loss buttons" have been distributed around the internal cavity periphery of a TWT. The loss buttons are formed from a ceramic material such as BeO or MgO that is mixed or doped with a conductive material, typically SiC. The loss buttons are typically cylindrical, with their axes parallel to the TWT axis and lodged in the tube wall.

To smooth out the TWT's frequency response, "reentrant loss buttons" have been used. These buttons project into the circuit cavities from the wall, and introduce a loss element by disrupting the RF wave within the tube. Non-reentrant, or tangent, loss buttons are also typically used, in which the edge of the button lies along a tangent to the inner cavity wall. The function of non-reentrant loss buttons, is to add loss over a narrow frequency range, such as near the upper cut-off frequency of the passband. This can be effectively used to eliminate upper cut-off instability, but it is not designed to smooth out the tube's amplification response over the full operating frequency band.

Non-reentrant loss buttons are doped with a relatively low level of SiC, typically 1–5%, as opposed to the typical 15% or greater doping for reentrant buttons used to smooth the frequency response over the operating band. The use of reentrant and non-reentrant loss buttons are described in U.S. Pat. Nos. 3,602,766 to Grant and 3,221,204 to Hant et al., respectively; both U.S. patents are assigned to Hughes Aircraft Company, the assignee of the present invention. Coupled-cavity TWTs and klystrons are described in general in A.S. Gilmour, Jr., *Microwave Tubes,* Artech House, Inc., 1986, pages 201–209 and 302–313.

Both reentrant and non-reentrant loss buttons typically have diameters equal to about half the field wavelength within the button for the frequencies they are designed to operate at. Since the conducting tube wall within which the loss button is positioned shorts out the parallel field component at the wall, and since the major electric field component in the button is the component in the direction of the beam axis, which is parallel to the button axis, the field at opposite ends of the button's diameter will typically be at a low or zero value. With a diameter approximately equal to half a wavelength of the field in the button, a resonant condition is established. Non-reentrant buttons, being made of material with a low percentage of lossy component, are highly frequency selective, with a high Q factor. They can provide significant loss over a narrow frequency range. Reentrant buttons, made of material with a high percentage of lossy component, have a more broad and shallow loss response.

While reentrant loss buttons are effective in smoothing out the tube's frequency response, they tend to disturb the circuit "match" at the ends of the tube by giving rise to internal cavity reflections. Such mismatches contribute to ripple in the amplification response, counteracting the smoothing effect of the loss. In practice, tubes with reentrant buttons require a greater effort in manufacture to achieve acceptable matches. Furthermore, they are not particularly efficient in terms of the amount of loss they introduce for a given button size and mass. Non-reentrant loss buttons can provide a large amount of loss at the cut-off region, but they are not effective in smoothing out the frequency response over the operating band.

An alternate approach to smoothing the frequency response is to provide an RF-loss coating along the tube's inner cavity walls. This technique is described in U.S. Pat. No. 3,453,491, also assigned to Hughes Aircraft Company. However, this technique is also less than ideal. More complex processing is required than the processing used for loss buttons, and the amount of loss that the coatings can provide is relatively limited.

In broadband klystrons, the cavities between the input cavity and the output cavity are designed to resonate at specific frequencies in or near the operating band, and the resonances have specified widths (values of cavity Q) for optimum broadband response. The cavity Q may be controlled by inclusion of RF loss, using loss coating or lossy ceramic elements as in a coupled-cavity circuit.

SUMMARY OF THE INVENTION

The present invention seeks to provide a broad spectrum coupled-cavity circuit that employs RF-lossy dielectric material in an efficient manner to provide a smooth broadband response without oscillations at the cut-off frequency, requires a relatively low amount of lossy material without complex processing, and achieves a good circuit match with low power-reflection. The technique is also applicable to a broadband klystron circuit, to achieve the required low values of cavity Q in an efficient and well-controlled manner.

These goals are accomplished with the use of a novel type of loss member in the form of RF-lossy dielectric slabs that exhibit a loss response over a wide frequency band, and preferably have a thickness of about ¼ of the wavelength induced within the slab. The slabs are preferably non-reentrant, with flat inner and outer surfaces, although other geometric configurations can also be used to provide a similar wideband frequency response.

The material used for the slabs can be the same as for prior reentrant loss buttons, but a more efficient use of the loss material is achieved and the circuit mismatch associated with prior reentrant buttons is avoided.

These and other features and advantages of the invention will be apparent to those skilled in the art from the following detailed description, taken together with the accompanying drawings.

DETAILED DESCRIPTION OF THE INVENTION

Figure 1:
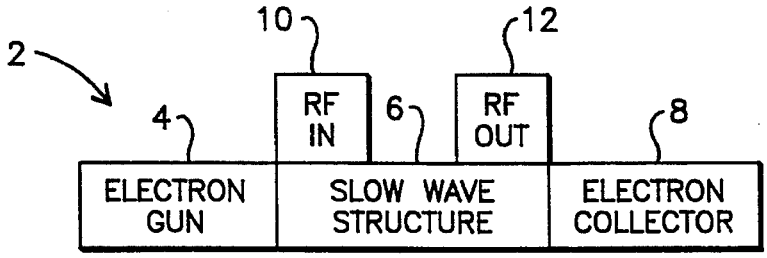
Fig.1 (Prior Art)
FIG. 1 is a block diagram of a conventional TWT, described above.
Figure 2:
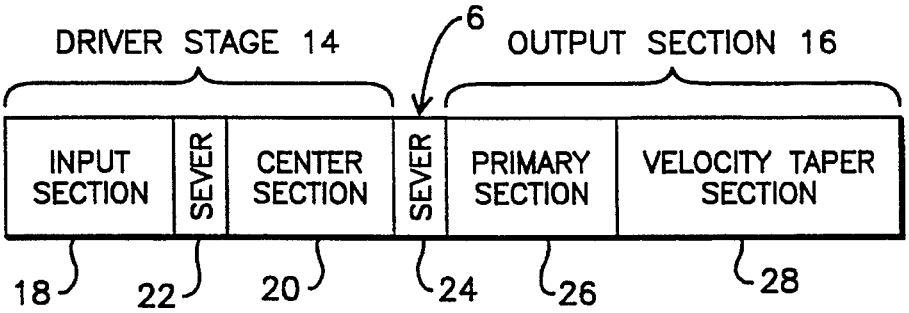
Fig.2 (Prior Art)
FIG. 2 is a block diagram of a conventional slow wave structure for a coupled-cavity TWT to which the invention is applicable.

A primary application for the invention is in coupled-cavity TWTs. A slow wave structure 6 for this type of device is illustrated in FIG. 2 and is described in further detail in U.S. Pat. No. 5,162,697 to Davis and Tammaru, also assigned to Hughes Aircraft Company. It includes a driver stage 14 and an output section 16. The driver stage 14 is divided into an input section 18 and a center section 20 by a sever section 22. The sever section 22 inhibits reflective waves that could result in oscillation due to excessive gain in an amplifying section, and typically includes a high loss material which absorbs substantially all of the traveling wave while enabling the velocity modulated electron beam to pass through unaffected. The electron beam entering the center section 20 generates a new traveling wave, which itself interacts with the electron beam to produce additional signal gain.

Another sever section 24 that provides the same function as sever section 22 is positioned between the driver stage 14 and the output section 16. The output section 16 typically includes a primary section 26 and a velocity taper section 28, with the primary section 26 operating at substantially the same phase velocity as the driver stage 14. The velocity taper section operates at a reduced phase velocity, and may include several sub-sections (not shown) to match the phase velocity reduction of the traveling wave to the axial velocity reduction of the electron beam. Its purpose is to increase the power conversion efficiency by extending the region of favorable beam-wave interaction.

The sections 18, 20, 26 and 28 have similar coupled-cavity structures. In accordance with the invention, specially designed RF-lossy dielectric slabs can be added to the cavities of each section to provide a generally uniform tube response over its full operating frequency range, without oscillations at the cut-off frequency. Loss slabs will generally be omitted from the velocity taper section 28, and perhaps also from the higher power end of the primary output section 26, because of the high RF power levels in these areas. The provision of loss slabs at these locations could result in loss of RF efficiency and excessive heat generation.

Figure 3:
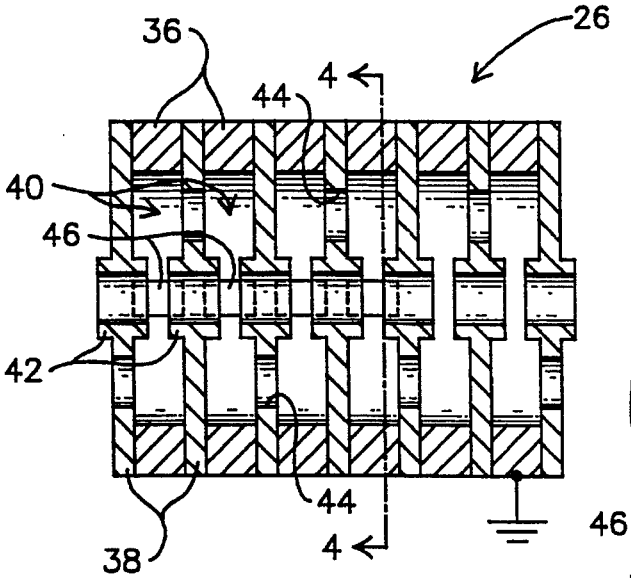
FIG. 3 is a sectional view showing the use of the invention in one section of a coupled-cavity TWT.
Figure 4:
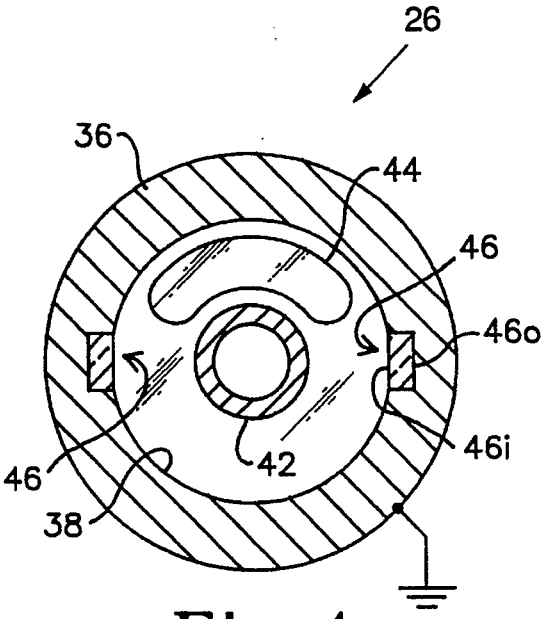
FIG. 4 is a sectional view taken along the line 4—4 of FIG. 3.
Figure 5:
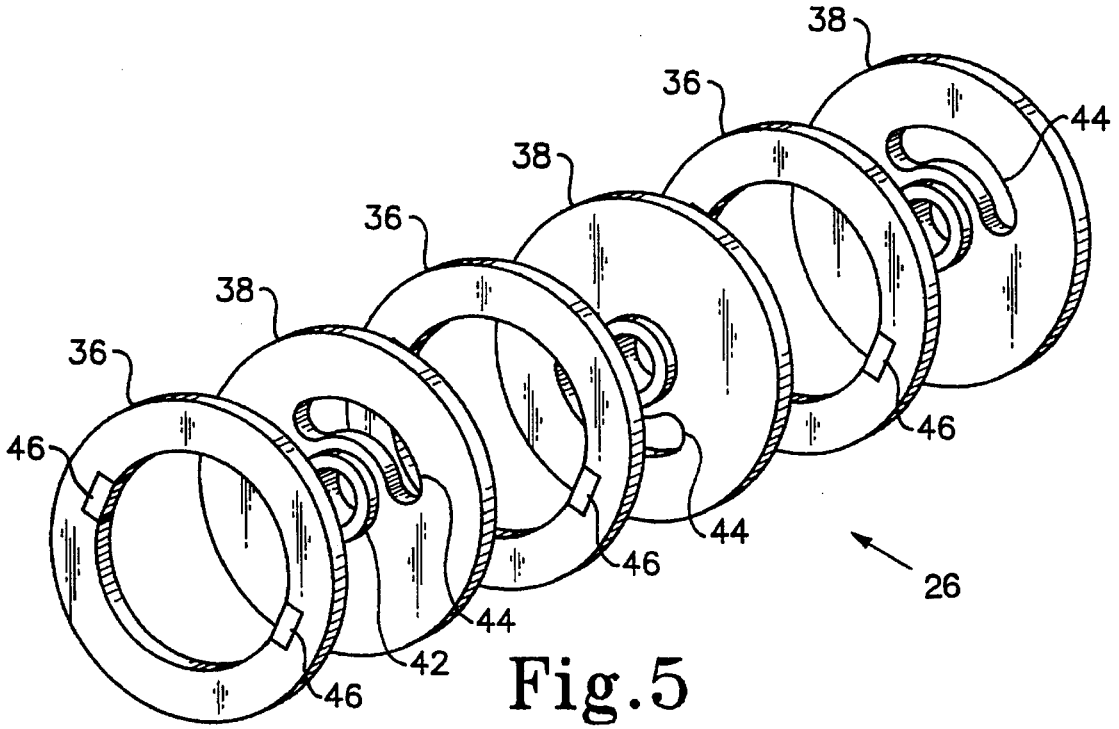
FIG. 5 is an exploded perspective view of a portion of the coupled-cavity section in FIG. 3.

A slow wave section that uses the loss slabs, such as primary section 26, is illustrated in FIGS. 3–5 (FIG. 5 includes elements of only three of the six cavities included in FIG. 3). The section is formed from alternating metal spacer rings 36 and disks 38 that are mechanically joined together around their outer peripheries, typically by brazing. Respective cavities 40 (see FIG. 3) are defined between each successive pair of disks 38, within the openings of spacer rings 36. Each disk includes a central tubular section 42 for propagation of the electron beam, and a slot 44 in the cavity wall between the tubular section 42 and the solid portions of spacer rings 36. The slots 44 are oriented along a vertical plane, with the slot for each successive disk staggered 180° with respect to the immediately preceding and immediately following disks. This configuration is referred to as a folded waveguide. As an RF wave propagates upward in one cavity, through the slot and downward to the adjacent cavity, the direction of the electric field reverses. Thus, there is basically a 180° phase shift from cavity to cavity, plus an additional phase delay associated with the time required for the wave to propagate from one cavity to the next. Instead of the staggered-slot arrangement shown in the drawings, coupled-cavity TWTs can also employ slots that are staggered by some angle less than 180°, or aligned from one cavity to the next, and a circuit can have more than one slot per disk.

In accordance with the invention, specially designed loss slabs 46 are positioned within the portion of the TWT wall defined by the spacer rings 36. Although a greater or lesser number of loss slabs could be used, preferably two loss slabs 46 are employed for each cavity, positioned along a horizontal diameter of the tube on opposite sides of the spacer rings 36. This orientation provides a high degree of uniformity in RF loss throughout the tube's overall pass band. The loss slabs could be positioned along a vertical diameter of the tube, but that would result in a significant reduction in loss at the lower end of the frequency passband. In FIG. 3 the loss slabs 46 are shown only for the first four cavities. The last two cavities on the right are shown without loss slabs, to illustrate a primary slow wave section 26 that employs the loss slabs only at its lower power end.

Figure 6A:
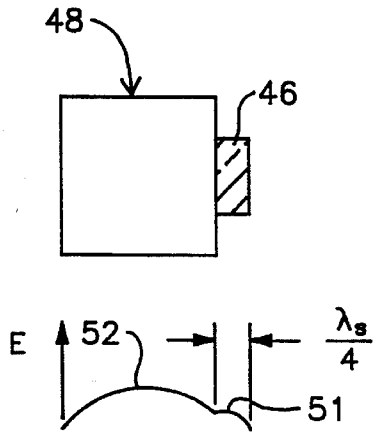
FIGS. 6*a* and 6*b* are wave diagrams illustrating the difference in RF field patterns between the slabs employed in the present invention and prior loss buttons.
Figure 6B:
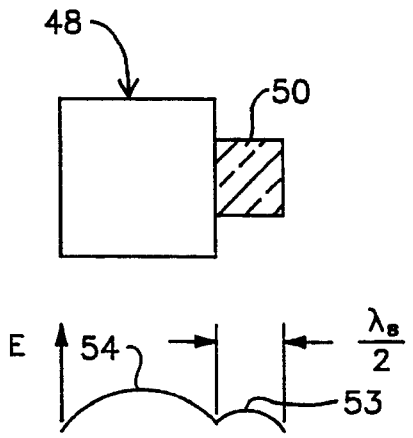
Fig.6b (PRIOR ART)

The loss slabs 46 are specially configured to establish a broadband response to an RF wave propagating through the tube. The concept is illustrated in FIGS. 6*a* and 6*b*, in which a generic TWT cavity 48 is schematically illustrated as being provided with the invention's loss slab 46 in FIG. 6*a*, and with a conventional loss button 50 in FIG. 6*b*. (To illustrate more clearly the conceptual difference between the slab and a loss button, the loss button is represented with a square cross-section, as opposed to a more typical cylindrical shape.) For a given power level in the main cavity, as represented by the magnitude of the electric field 52 (see FIG. 6*a*) and 54 (see FIG. 6*b*), the amount of power absorbed in the lossy ceramic in each case depends upon the characteristic of the lossy material, and on the dimensions of the lossy element.

Maximum power absorption at a given operating frequency is attained when the thickness of the loss slab is approximately a quarter of the wavelength $\lambda_s$ generated in the slab. The invention makes use of this property by providing the loss slab 46 with a thickness approximately equal to $\lambda_s/4$ in the frequency band over which the RF loss is desired. The resulting electric field pattern 51 forms a non-resonant pattern within the loss slab 46, as illustrated in the lower portion of FIG. 6*a*. Note that the field waveform 51 within the slab has a shorter wavelength than the field waveform 52 within the evacuated Cavity, due to the difference in dielectric constants.

The quarter-wavelength non-resonant field in the slab 46 can be contrasted with the more conventional loss button 50, which has double the thickness of the slab 46. The fields in the loss button at sustained resonance form a half-wavelength pattern 53, as illustrated in the lower portion of FIG. 6*b* when the thickness of the loss slab is approximately one half of the wavelength $\lambda_s$ generated in the slab; the longer field pattern in the cavity is identified by reference number 54. The factor of two difference in thickness results if the loss slab 46 and the loss button 50 are formed from the same material. When the loss button has a lower percentage of conductive material with a lower dielectric constant, such as for prior non-reentrant resonant loss buttons, the button would be even thicker to establish resonance.

Another way of stating the difference between the lossy slab 46, which has a low Q, and the resonant button 58 which has a high Q, is that the fields in the slab die out rapidly if they are not sustained by a driving field from the TWT. The coupling from the tube to the slab must be strong to maintain the fields within the slab if it is absorbing power. With the slab thickness equal to approximately a quarter wavelength, the field amplitude in the slab will be maximum at the coupling plane with the cavity. In the resonant element 50, by contrast, the fields are self-contained within the button. The fields essentially sustain themselves, and only a small amount of power needs to be coupled in from the tube to maintain the resonance. Thus, the quarter-wavelength slab 46 provides a strong coupling with a high degree of RF loss to the tube, while the more conventional half-wavelength button 50 provides a lower amount of loss.

In FIG. 4, the loss slab 46 has one face 46*i* which faces into the interior of the cavity, and an opposite face 46*o* that is in contact with the metallic spacer ring 36. The conducting metal at the face 46*o* keeps the electric field (more specifically its axial component, which is the major component) zero at this surface, as illustrated in FIG. 6*a*. A small gap between the slab face 46*o* and the metal surface, which may exist in an actual TWT, will not change the field characteristics in the slab significantly.

The preferred dielectric material for the loss slabs is BeO, which has a high thermal conductivity. MgO has also been used in the past for loss buttons; AlN and $Al_2O_3$ are other candidate materials. SiC is the conventional conductive dopant material that is mixed with the dielectric, but other materials like TiC might also be used. With a BeO/SiC mixture, the proportion of SiC should be at least 15%, with an approximate 40% proportion preferred to provide the desired low Q.

The loss slabs 46 are generally held in place within their respective spacer rings 36 by machining an opening in the ring with a shape corresponding to that of the loss slab, and then inserting the slab into the opening. The slab is held against lateral movement by the slotted disks on either side of the ring when the tube is assembled, while radial movement of the slab is prevented either by the shape of the slab and its corresponding ring opening, and/or by a mechanical securing mechanism. Various possible slab configurations are illustrated in FIGS. 7*a*–7*f*.

Figure 7A:
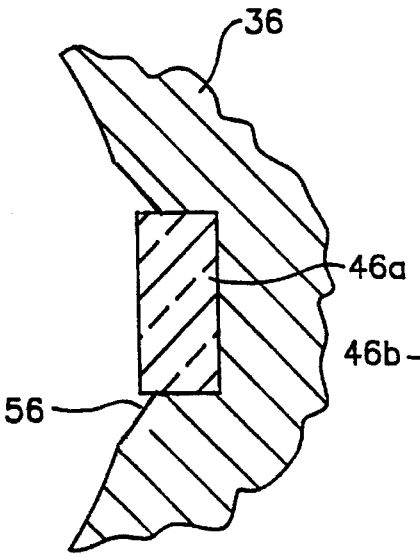
FIG. 7*a* is a fragmentary sectional view of the RF-lossy slabs having a rectangular shape.
Figure 7B:
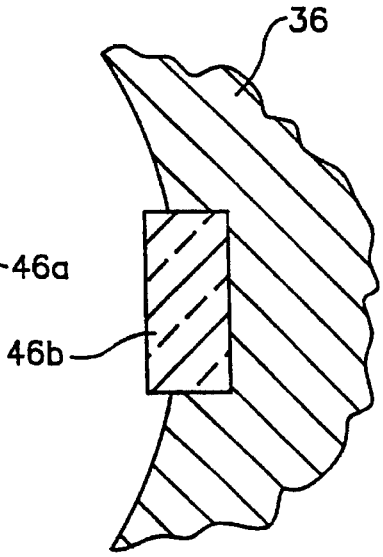
FIG. 7*b* is a fragmentary sectional view of the RF-lossy slabs having a reentrant position with respect to the cavity.

In FIG. 7*a*, the slab 46*a* has a rectangular cross-section, with its inner surface tangent to the circular circumference of the cavity within spacer ring 36. The amount of RF loss which it provides is increased by extending the slab opening with an iris 56 that flares away from the upper and lower edges of the slab. This allows the RF magnetic field within the tube to expand more deeply into the slab, and thereby establish a stronger coupling. Flaring the slab opening has not been found to make it more difficult to maintain a good match in a coupled-cavity circuit. Another way to increase the RF loss is illustrated in FIG. 7*b*, in which the slab 46*b* has a reentrant position with respect to the cavity within spacer ring 31. As a practical matter the amount of loss that can be added in this manner is more limited, since the circuit match is degraded if the reentrancy extends beyond a small amount.

The slabs 46*a* and 46*b* shown in FIGS. 7*a* and 7*b* are retained within their respective spacer ring openings by active metal brazing. However, because of different thermal expansion rates for the slab ceramic and the copper typically used for the spacer rings, the brazed joint will be under stress for changing temperatures. One way to reduce the risk of joint failure is to provide a layer of wavefin or buffer material comprised of flexible copper between the slab and the mating surface of the spacer ring 36. This technique and wavefin or buffer material, as applied to brazing collector electrodes to insulating ceramic cylinders, is described in U.S. Pat. No. 4,504,762 to Hart et al., assigned to Hughes Aircraft Company. The slab can also be captured mechanically, as illustrated in FIG. 7*c*–7*f*.

Figure 7C:
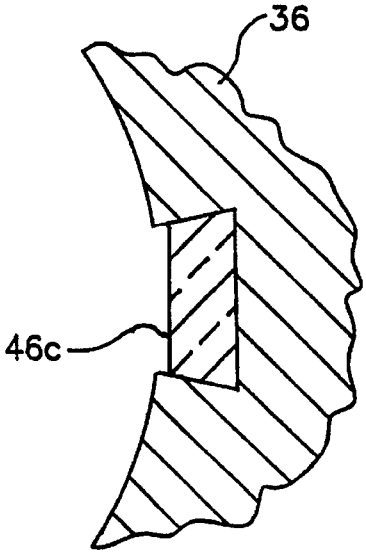
FIG. 7*c* is a fragmentary sectional view of the RF-lossy slabs having a trapezoidal shape.
Figure 7D:
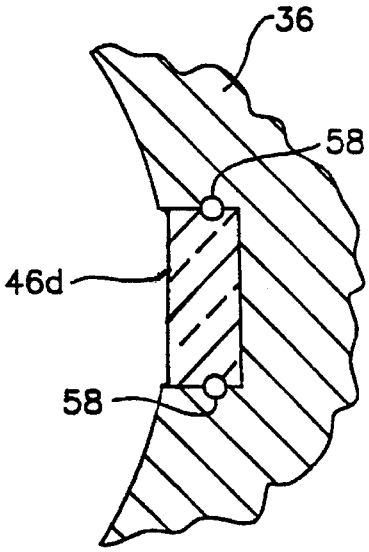
FIG. 7*d* is a fragmentary sectional view of the RF-lossy slabs having a rectangular shape with small pins set into grooves along the upper and lower slab edges.
Figure 7E:
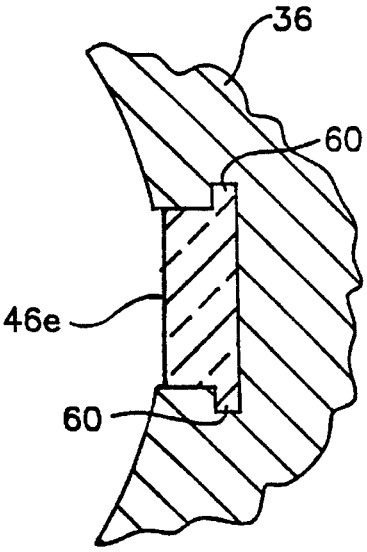
FIG. 7*e* is a fragmentary sectional view of the RF-lossy slabs having integral upper and lower extensions.
Figure 7F:
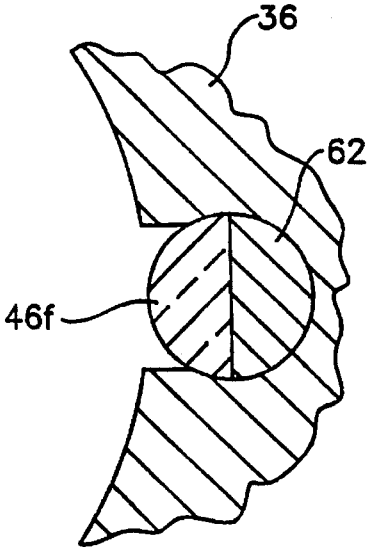
FIG. 7*f* is a fragmentary sectional view of the RF-lossy slabs formed from cylindrical loss buttons.

In FIG. 7*c* the slab 46*c* and the mating opening in the spacer ring 36 have trapezoidal shapes, with a maximum dimension at the inner end of the opening and a minimum dimension along the edge of the cavity. In FIG. 7*d*, the slab 46*d* is rectangular within spacer ring 36, with small pins 58 set into grooves along the upper and lower slab edges and the mating surfaces of the ring opening to hold the slab in place. In FIG. 7*e* the inner end of slab 46*e* includes integral upper and lower extensions 60 that mate with corresponding slots in the spacer ring 36 opening to prevent the slab from dislodging. In FIG. 7*f* the slab 46*f* is formed from a cylindrical loss button, the back half of which is ground away and replaced with a metal plug 62. The metal plug provides a mechanical and electrical interface with the rear of a cylindrical opening in the spacer ring 36, with the radius of the slab 46*f* approximately equal to a quarter-wavelength within the slab. Although the thickness of the lossy ceramic is less than a quarter-wavelength towards its upper and lower ends, the field becomes zero at these ends due to the conducting enclosure, and the major part of the field energy is concentrated at the central region of the half-button where the thickness is a quarter-wavelength.

Loss slabs as illustrated in FIG. 7*a* were used in a demonstration of the invention in a TWT designed to operate over the frequency band 3.1 to 3.5 GHz. The cavity diameter was 4.496 cm, while the length (parallel to the cavity axis) of both the slab 46*a* and the spacer ring 36 was 1.715 cm. The slab was 0.559 cm thick (the horizontal dimension in FIG. 7*a*) and 0.940 cm high (the vertical dimension in FIG. 7*a*). The iris 56 had a width of 0.940 cm at the upper and lower edges of the slab, and expanded to a width of 1.295 cm at a flare angle of 34° to horizontal. The slab material was BeO/SiC, with a 40% SiC component.

The wavelength $\lambda_s$ within the slab, when captured in the metal ring, can be determined from the equation $$\lambda_s=\lambda_o[\epsilon_r-(\lambda_o/\lambda_c)^2]^{-1/2},$$

where $\lambda_o$ is the free space wavelength (the speed of light in free space divided by the frequency), $\epsilon_r$ is the relative dielectric constant of the slab material, and $\lambda_c$ is the cut-off wavelength within the slab, equal to twice the slab height. With an $\epsilon_r$ equal to 45, a quarter of a slab wavelength at the center operating frequency of 3.3 GHz is 0.488 cm. Although the slab thickness of 0.559 cm was somewhat greater than the nominal optimum thickness of 0.488 cm, the tube exhibited a gain ripple of less than 1 dB over the 3.1–3.5 GHz band. This represented a very significant improvement for this type of TWT, which typically exhibits a gain ripple of at least 3 dB without the loss slabs. Furthermore, the tube did not oscillate at the upper cut-off frequency, even though no separate upper cutoff loss buttons were used. The less than 1 dB gain ripple was achieved at a small signal drive level, at which the ripple is normally most severe.

This demonstration showed that significant improvements can be obtained when the slab thickness is approximately equal to a quarter-wavelength within the slab. The critical factor is that the slab thickness be substantially closer to a quarter-wavelength than to a half-wavelength resonant dimension to provide a broadband response with a significant amount of loss.

Figure 8:
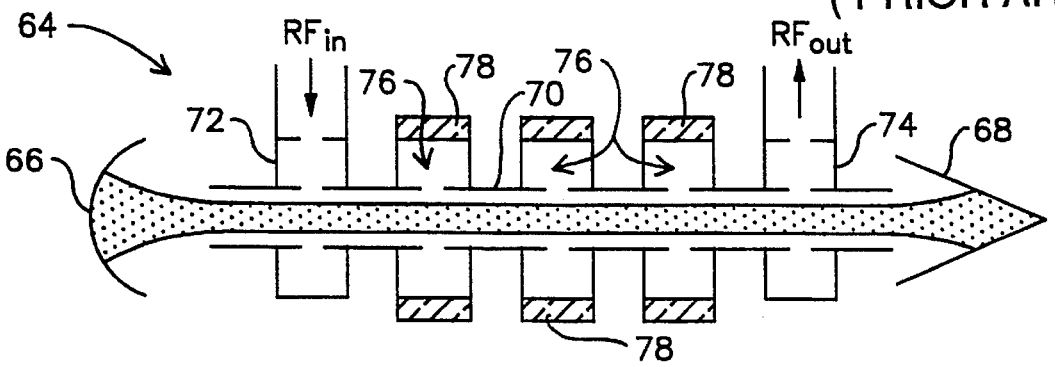
FIG. 8 is a block diagram illustrating the application of the invention to a klystron.

FIG. 8 illustrates the application of the invention to a conventional klystron tube 64. The klystron includes an electron gun 66 at one end, an electron collector 68 at its opposite end, and an intermediate tube structure 70. An RF signal is supplied through an inlet port 72 near the electron gun end of the tube, with the amplified RF signal extracted out through an outlet port 74 near the collector end of the tube. In contrast to coupled-cavity TWTs, in which an electron beam-RF interaction takes place continuously along the tube and the RF energy propagates along the interaction structure in addition to being carried along by the electron beam, with a klystron the interactions take place at discrete locations along the beam and the RF signal is carried from cavity to cavity only by the beam. The klystron interaction cavities are indicated by reference number 76, with lossy slabs 78 positioned around the edges of the cavities. In some cases, an intermediate cavity may be composed of two or more cavities that are coupled through slots, as in a coupled-cavity circuit, to form a resonant composite cavity. In either case, the intermediate cavities are operated in a resonant mode rather than a traveling wave mode, and the Q of the resonance is the important design parameter. Lossy slabs can be used effectively to achieve the desired cavity Q, since it depends on the number of slabs as well as on the strength of the coupling between each slab and the cavity, and the coupling can be adjusted by the amount of flaring of the coupling iris or by reentrancy.

While several different embodiments of the invention have been shown and described, numerous variations and alternate embodiments will occur to those skilled in the art. Accordingly, it is intended that the invention be limited only in terms of the appended claims.

We claim:

1. A linear-beam tube with a smoothed radio frequency (RF) amplification as a function of frequency, comprising:

an RF source, a tube having an interior portion, an exterior portion, and having cylindrical tube walls that surround an electron beam-field wave interaction area, said tube supporting an RF field generated by the RF source within a predetermined operating frequency range, a plurality of openings in said tube walls, respective slabs of an RF lossy dielectric material lodged in said openings and exposed to the interior portion of said tube, said slabs having a thickness of less than approximately half a wavelength of said predetermined operating frequency range and configured to provide substantially non-resonant RF loss sites to the RF field in the tube within said frequency range.

2. The linear-beam tube of claim 1, said slabs having inner sides that face into and are exposed to the interior portion of said tube, and outer sides that face away from the interior portion of said tube, said openings further comprising an electrically conducting surface in close proximity to the outer sides of said slabs.

3. The linear-beam tube of claim 2, wherein the outer sides of said slabs are also substantially flat.

4. The linear-beam tube of claim 2, said slabs having inner sides that face into and are exposed to the interior portion of said tube, and outer sides that face away from and are shielded from the interior portion of said tube, wherein the inner sides of said slabs are substantially flat.

5. The linear-beam tube of claim 4, said slabs having inner sides that are substantially flat and disposed substantially along tangents to the cylindrical tube walls.

6. The linear-beam tube of claim 4, wherein at least some of said openings in the tube wall are flared laterally from opposed edges of respective slabs along the interior portion of the cylindrical tube wall.

7. The linear-beam tube of claim 1, wherein said slabs comprise a dielectric material having a conductive doping content of at least about 15%.

8. The linear-beam tube of claim 1, said tube comprising a coupled-cavity traveling wave tube (TWT) with respective slabs disposed in multiple cavities of said TWT.

9. The linear-beam tube of claim 8, wherein said RF source generates a low RF power input into said tube and said tube increases said power input to a high RF power output, wherein said TWT has said multiple cavities between said low RF power input and said high RF power output, and wherein said slabs are not provided in at least one cavity proximate said high RF power output.

10. A linear-beam tube with a smoothed radio frequency (RF) amplification as a function of frequency, comprising:

an RF source, a tube having an interior portion, an exterior portion, and having cylindrical tube walls that surround an electron beam field interaction area, said tube supporting an RF field generated by the RF source within a predetermined operating frequency range, a plurality of openings in said tube walls, respective slabs of an RF lossy material lodged in said openings, said slabs having respective inner sides that face into and are exposed to the interior portion of said tube and respective outer sides opposite said inner sides, said inner sides of said slabs being substantially tangent to the cylindrical tube walls, said slabs having respective thicknesses within a range of between one eighth wavelength and three eighths wavelength of the predetermined operating frequency range of the RF field in the tube, and an electrically conducting surface in close proximity to the outer sides of said slabs.

11. The linear-beam tube of claim 10, wherein said slabs comprise a dielectric material having a conductive doping content of at least about 15%.

12. The linear-beam tube of claim 10, wherein the inner sides of said slabs are substantially flat.

13. The linear-beam tube of claim 10, wherein the outer sides of said slabs are substantially flat.

14. The linear-beam tube of claim 10, said tube comprising a coupled-cavity traveling wave tube (TWT) with respective slabs disposed in multiple cavities of said TWT.

15. The linear-beam tube of claim 14, wherein said RF source generates a low RF power input region and said tube increases said power input to a high RF power output region, said TWT has said multiple cavities between said low RF power input region and said high RF power output region, and wherein said slabs are not provided in at least one cavity proximate of said high RF power output region.

16. The linear-beam tube of claim 10, wherein at least some of said openings in the tube wall are flared laterally from opposed edges of respective slabs along the interior portion of the tube wall.

17. The linear-beam tube of claim 10, wherein said slabs have inner sides which are substantially flat.

* * * * *